US006315743B1

(12) United States Patent
Guest

(10) Patent No.: US 6,315,743 B1
(45) **Date of Patent: *Nov. 13, 2001**

(54) PRESSURE APPLICATION APPARATUS FOR REDUCING STRESS AND RELIEVING HEADACHES

(75) Inventor: Jack Guest, 1120 Oro Vista, Litchfield Park, AZ (US) 85340

(73) Assignee: Jack Guest

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/102,795

(22) Filed: Jun. 23, 1998

(51) Int. Cl.[7] ..... A61H 7/00
(52) U.S. Cl. ..... 601/134; 606/204.15
(58) Field of Search ..... 606/201, 202, 606/203, 204, 204.15, 130; 602/17; 601/134

(56) References Cited

U.S. PATENT DOCUMENTS

| | | | | |
|---|---|---|---|---|
| 1,459,093 | | 6/1923 | French . | |
| 2,482,838 | | 9/1949 | Carlson . | |
| 2,664,884 | | 1/1954 | La Verne . | |
| 3,934,316 | | 1/1976 | Driscoll . | |
| 4,234,176 | | 11/1980 | Goff et al. . | |
| 4,386,602 | * | 6/1983 | Sheldon et al. | 606/130 |
| 4,465,069 | * | 8/1984 | Barbier et al. | 606/130 |
| 4,506,659 | | 3/1985 | Chester . | |
| 4,617,925 | * | 10/1986 | Laitnen | 606/130 |
| 4,962,918 | | 10/1990 | Yang . | |
| 5,036,949 | | 8/1991 | Crocker et al. . | |
| 5,140,978 | | 8/1992 | Sirninger . | |
| 5,207,688 | * | 5/1993 | Carol | 606/130 |
| 5,695,501 | * | 12/1997 | Carol et al. | 606/130 |

* cited by examiner

*Primary Examiner*—Justine R. Yu
(74) *Attorney, Agent, or Firm*—Snell & Wilmer LLP

(57) ABSTRACT

An apparatus for applying substantially constant pressures to the temple areas of a user's head, thereby relieving the user's headache is provided. A preferred embodiment of the apparatus comprises a C-shaped frame member which fits over the top of the user's head such that each end of the frame member is substantially aligned with a respective one of the user's two temple areas. Each end of the frame member is further coupled to a head contact assembly which, in use, is pressed against a respective one of the two temple areas of the user's forehead. Each head contact assembly is user-adjustable, preferably comprising a threaded screw member which screws through a corresponding threaded hole in a respective end of the C-shaped frame member. This allows the user to turn the head contact assembly either clock-wise or counter clock-wise, effectively increasing or decreasing the amount of pressure applied by the apparatus to each of the user's respective temple areas. The apparatus may also include a height adjustment assembly coupled to the top of the C-shaped frame member which allows the user to adjust the height of the frame member above his or her head, thereby adjusting the vertical position of the two head contact assemblies with respect to the user's respective temple areas.

4 Claims, 5 Drawing Sheets

PRESSURE APPLICATION APPARATUS FOR REDUCING STRESS AND RELIEVING HEADACHES

BACKGROUND OF THE INVENTION

It is known that applying pressure to a person's forehead and/or scalp tends to help to dramatically reduce stress and relieve headaches. Typically, a person will do so by pressing and/or rubbing his or her fingers against the particular areas on the head that result in the greatest comfort. Often the pressure is applied through massage, and to this end, a number of inventions have been derived in attempt to replicate the use of one's hands by providing massage apparatuses which fit around a user's head. For examples of various head-massaging apparatuses, see Carlson, U.S. Pat. No. 2,482,838, issued Nov. 4, 1947; La Verne, U.S. Pat. No. 2,664,884, issued Jan. 5, 1954; and Chester, U.S. Pat. No. 4,506,659, issued Mar. 26, 1985.

However, the above-mentioned apparatuses are typically complicated, heavy, expensive to manufacture, uncomfortable to use, and/or inherently aesthetically displeasing for use in public or work environments. Furthermore, these apparatuses have generally failed to recognize that the application of a static and constant pressure to the temple areas of one's forehead can provide equal or even greater success in relieving stress and headaches than the above-mentioned massaging techniques. Accordingly, an invention is needed which recognizes the benefits of applying a constant and static pressure to the temple areas and further provides a light-weight, inexpensive, comfortable, and inherently aesthetically pleasing apparatus which can be worn at home, work, or in public.

SUMMARY OF THE INVENTION

Accordingly, the present invention provides an inexpensive, light-weight, and aesthetically pleasing apparatus which can advantageously be variously configured to apply a constant pressure to areas of a user's head to help relieve the user's stress and/or headaches. While preferred embodiments of the invention are described below, the invention generally comprises any frame which can be placed on or around the user's head such that pressure can be applied to each of the user's two temple areas. While any type of frame is contemplated as being within the scope of the invention, typically the frame will comprise either a rigid frame or a stretchable headband, each of which serve to keep the apparatus firmly and comfortably coupled to the user's head while in use.

In accordance with one preferred embodiment of the present invention, a C-shaped rigid frame member may be provided which substantially fits over the top of a user's head. Each end of the frame member suitably includes a threaded hole for accepting a screw-like head contact assembly. Moreover, a third threaded hole may be provided at the top of the C-shaped frame member for accepting a height adjustment assembly.

In accordance with a further aspect of this preferred embodiment, two screw-like head contact assemblies are suitably provided which screw horizontally into the holes in each end of the frame member. The outer end of each screw-like assembly preferably includes a knob while the inner end of each screw-like assembly is preferably connected to a pressure pad. In use, the two pressure pads may be substantially aligned with and placed against the user's respective two temple areas. The user can then adjust the amount of pressure applied to each temple by turning each knob clock-wise or counter clock-wise, thereby increasing or decreasing the amount of pressure applied through each pressure pad to the user's left and right temple areas.

In accordance with another aspect of this preferred embodiment, a height adjustment assembly is suitably provided which screws vertically into the hole in the top of the C-shaped frame member. The outer end of the height adjustment assembly preferably includes a knob while the inner end of the height adjustment assembly is preferably connected to a pressure pad. In use, the pressure pad may be substantially aligned with and placed against the top of the user's head. The user can then adjust the amount of space between the C-shaped frame and the top of the user's head by turning the height adjustment assembly either clockwise or counter-clockwise, thereby vertically adjusting the position of the head contact assemblies' pressure pads with respect to the user's temple areas.

In accordance with yet another embodiment of the present invention, the frame member is suitably configured such that the inner circumferential portion of its cross-section may be rectangularly shaped and the outer circumferential portion of its cross-section may be rounded. This frame member configuration results in lighter weight and greater strength, adding to user comfort and lowering manufacturing costs. Furthermore, this design provides the frame with an aesthetically pleasing look.

In accordance with another preferred embodiment of the invention, the frame member may comprise an elastic headband which fits horizontally around the upper portion of a user's head. The interior surface of the headband preferably includes two pressure pads which, in use, may be substantially aligned with and placed against the user's two respective temple areas.

BRIEF DESCRIPTION OF THE DRAWINGS

The present invention will hereinafter be described in conjunction with the appended drawing figures, wherein like numerals denote like elements, and.

DETAILED DESCRIPTION OF PREFERRED EXEMPLARY EMBODIMENTS

Figure 2:
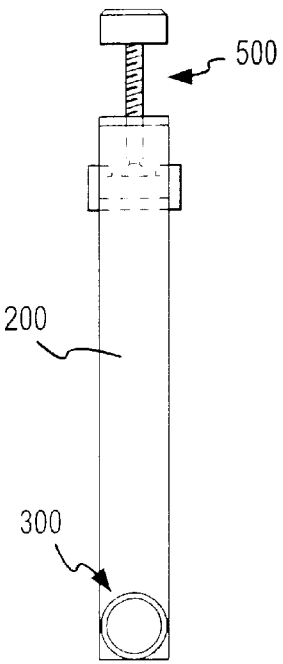
FIG. 2 is a side view of a pressure application apparatus.
Figure 1:
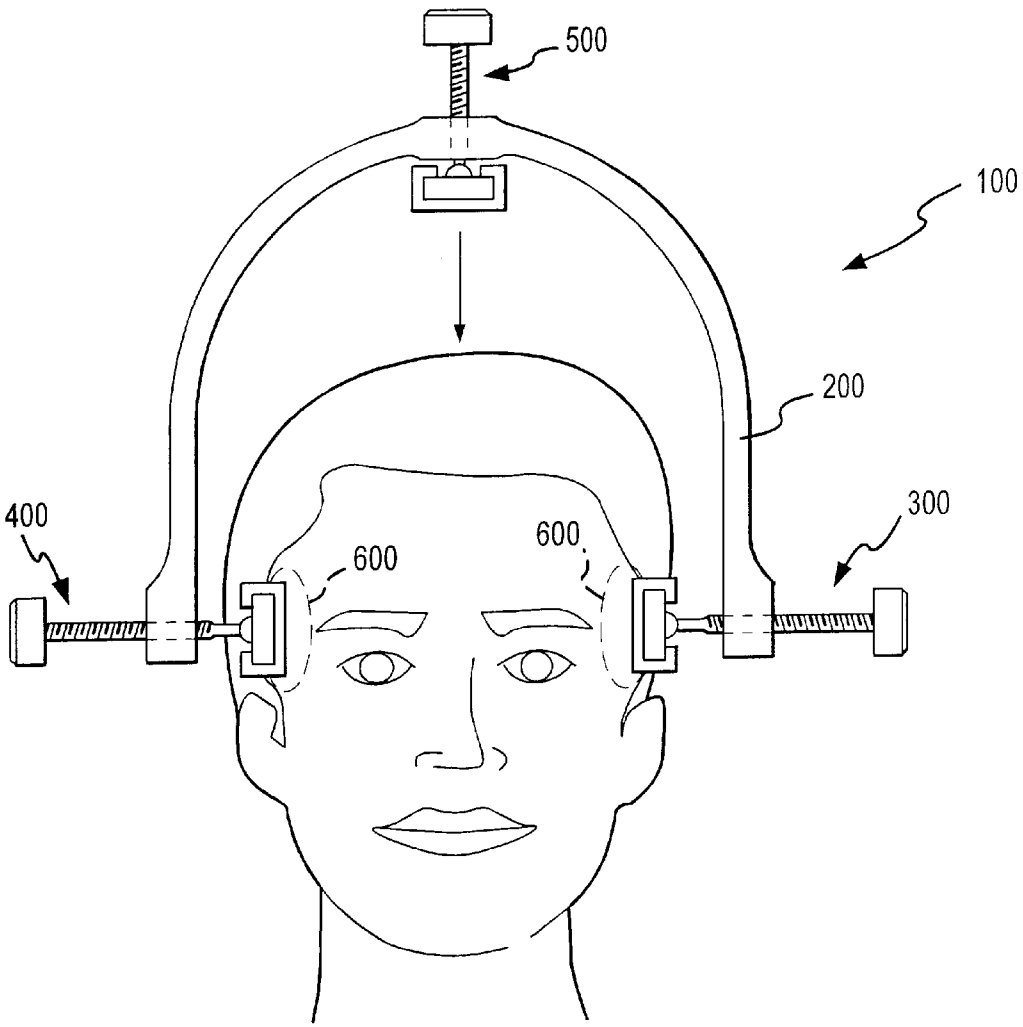
FIG. 1 is a front view of a pressure application apparatus.

FIGS. 1 and 2 illustrate a first preferred embodiment of a pressure application apparatus in accordance with various aspects of the present invention. The apparatus 100 suitably comprises a C-shaped rigid frame member 200 substantially configured to fit around the top of a human head. Furthermore, apparatus 100 suitably comprises a first contact assembly 300, a second contact assembly 400, and a height adjustment assembly 500. In operation, a user can place apparatus 100 over the top of his or her head such that first and second head contact assemblies 300 and 400 are substantially aligned with the user's left and right temple areas 600, respectively, and such that height adjustment assembly 500 rests on the top of the user's head. As head contact assemblies 300 and 400 are rotated, e.g. clockwise, pressure is applied to the user's left and right temple areas 600 by transferring the tension provided by rigid frame member 200 into pressure forces against the temple areas 600. When a user is finished using the apparatus, he or she simply pulls each end of frame member 200 away from his or her head and removes the apparatus.

As will be appreciated by those skilled in the art, any number of devices can suitably be configured to carry out this pressure application. While the present invention contemplates each of these modifications as are now known or hereafter devised by those skilled in the art, various configurations are presently believed to be particularly advantageous.

Figure 3:
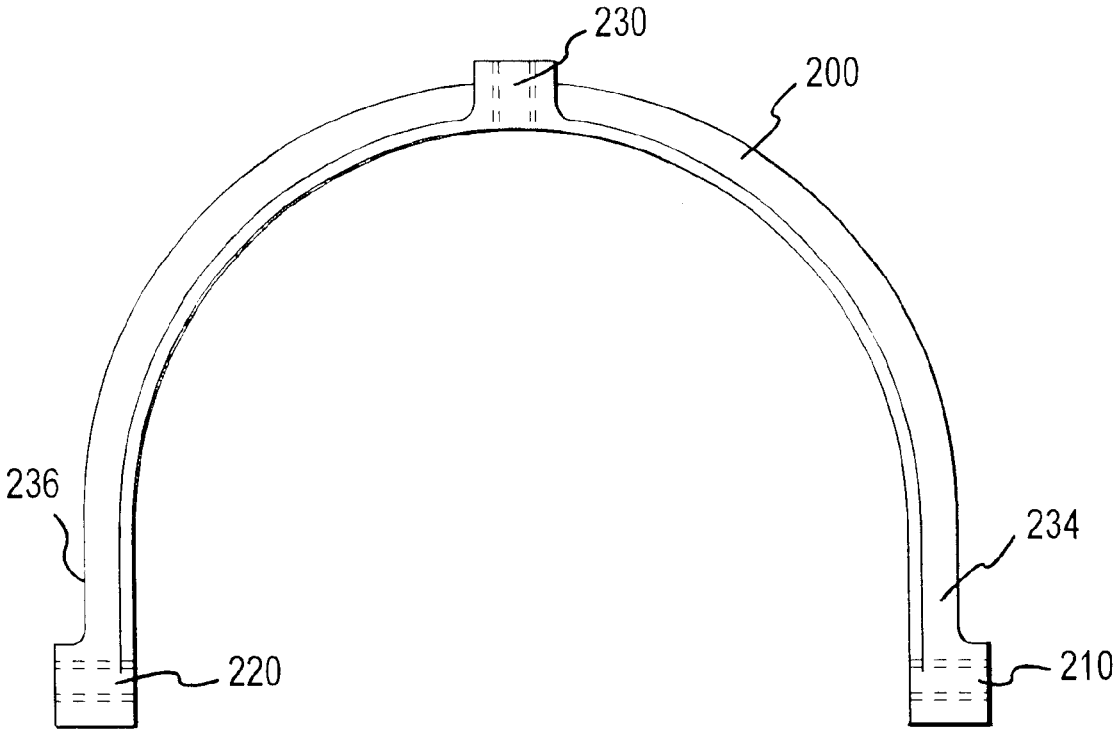
FIG. 3 is a front view of a frame member.
Figure 4:
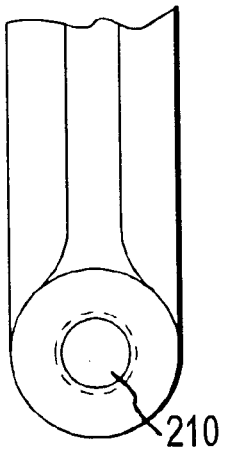
FIG. 4 is a side sectional view of a frame member of FIG. 3.
Figure 5:
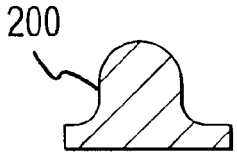
FIG. 5 is a cross sectional view of a frame member of FIG. 3.

Referring now to FIGS. 3, 4, and 5, a preferred embodiment of frame member 200 will now be discussed. Frame member 200 is preferably composed of a rigid material, for example, plastic, metal, stainless steel spring metal, ceramic, or any other suitably rigid material. Frame member 200 may be substantially C-shaped, preferably with a semi-circular upper portion having a radius of approximately 3½". Both ends of the upper portion then may be extended parallel to each other for some additional length, for example 1½", as shown at respective sections 232 and 234. At the top of frame member 200, a height adjustment hole 210 is suitably provided to accept a height adjustment assembly 500 (as shown in FIG. 1). Furthermore, the left and right ends of frame member 200 preferably include head contact assembly holes 220 and 230 for accepting head contact assemblies 300 and 400, respectively (as shown in FIG. 1). Holes 210, 220 and 230 are suitably drilled using a standard threading, for example ⅜" 16 National Course Class 2 threads. As shown in FIG. 5, the cross-sectional shape along the inner circumference of frame member is preferably rectangular (e.g., ¾" by ⅛") while the cross-sectional shape along the outer circumference of frame member 200 is preferably semi-circular (e.g., ⅜" diameter).

Referring now to FIGS. 6–11, alternate embodiments of frame member 200 will now be discussed, illustrating a number of possible embodiments encompassed by the present invention. As noted above, it is important to note that a C-shaped frame member 200 is only one preferred embodiment, and that frame member 200 may utilize a number of different shapes or cross-sections, and may be configured to fit over, under, or around a user's head. Furthermore, one skilled in the art will quickly recognize that head contact assemblies 300 and 400 also may take on many different embodiments without departing from the scope of the present invention.

Figure 6:
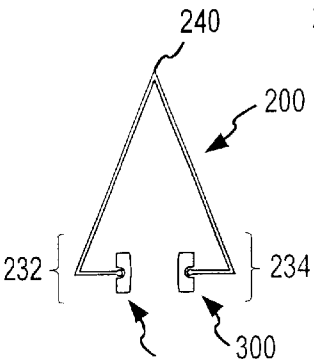
FIG. 6 is a front view of an alternate embodiment of a pressure application apparatus.

For example, FIG. 6 illustrates an embodiment of the present invention wherein frame member 200 is substantially V-shaped, as opposed to C-shaped, comprising a single central angular joint 240. As so configured, frame 200 suitably includes angled sections 232 and 234, configured to align head contact assemblies 300 and 400 with a user's temple areas 600. Frame member 200 may be worn such that angular joint 240 is above the head or below the chin. When pressure pads 300 and 400 are placed against a user's temple areas 600, frame member 200 is stretched apart about angular joint 240, providing a constant pressure against each of temple areas 600.

Figure 7:
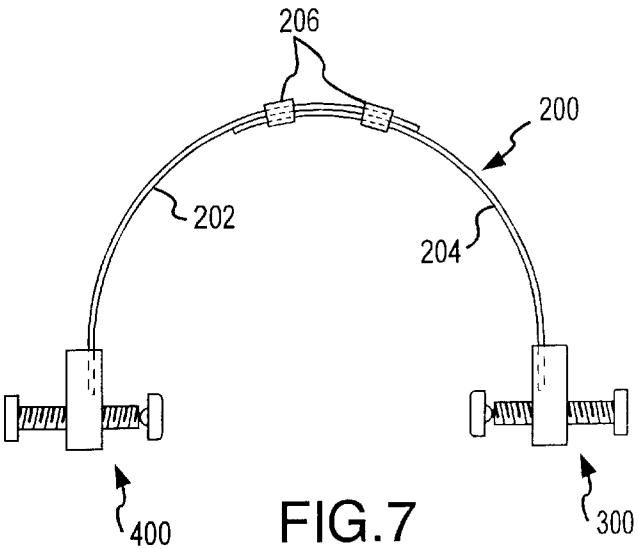
FIG. 7 is a front view of an alternate embodiment of a pressure application apparatus.
Figure 11:
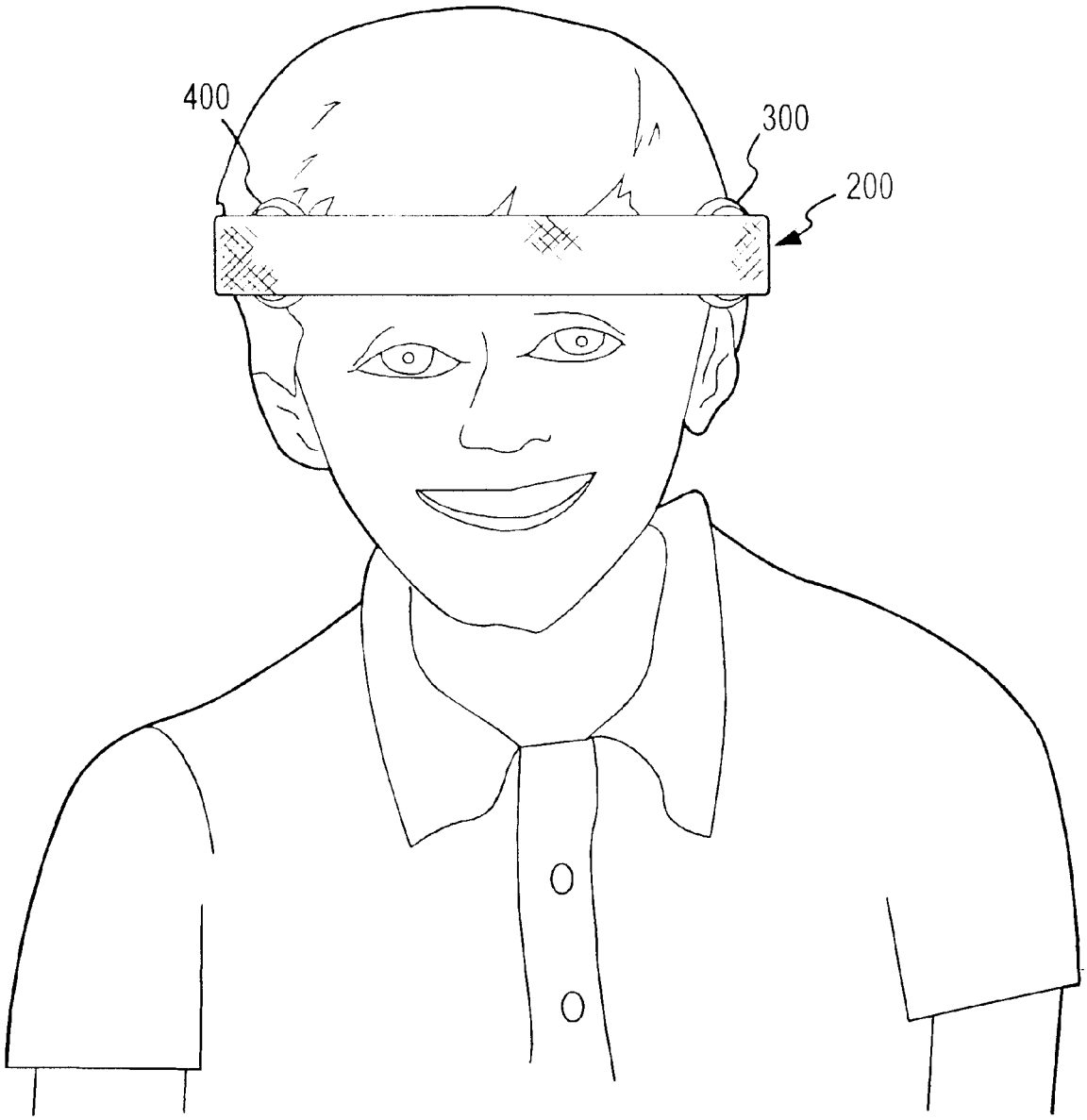
FIG. 11 is a front perspective view of an alternate embodiment of a pressure application apparatus.

Another exemplary embodiment is illustrated by FIG. 7 wherein an adjustable C-shaped frame member 200 may comprise a first frame member component 202 and a second frame member component 204, both made of, for example, 3/32" stainless steel spring wire. First frame member component 202 may be adjustably coupled to second frame member component 204 by slidable couplings 206. Slidable couplings 206 may be statically coupled to first frame member component 202 and adjustably coupled to frame member component 204, allowing translational movement of component 204 through slidable couplings 206 along the underside of component 202 for adjustment. Slidable couplings 206 thereby provide a means for adjusting the constant pressure applied by head contact assemblies 300 and 400 to a user's temple areas 600, by reducing or enlarging the overall length of frame member 200 between head contact assemblies 300 and 400. The embodiment of FIG. 7 further illustrates the use of plastic head contact assemblies 300 and 400, which also may be spring loaded to enhance the amount of pressure applied to a user's temple areas 600.

Figure 8:
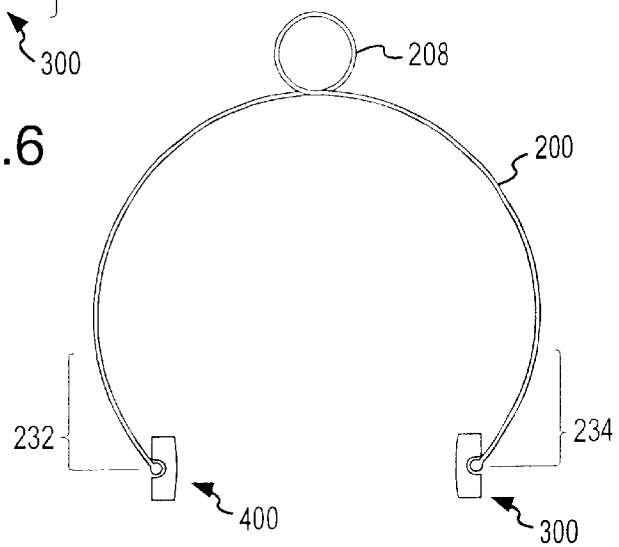
FIG. 8 is a front view of an alternate embodiment of a pressure application apparatus.

FIG. 8 illustrates yet another embodiment of frame member 200 which allows the user to wear the invention either on the head or under the chin, providing greater flexibility. The frame member 200 in FIG. 8 may be substantially C-shaped, suitably made of 3/32" spring wire, and configured in a substantially circular shape about sections 232 and 234, as opposed to the substantially straight and parallel configuration of sections 232 and 234 of the embodiment illustrated in FIG. 3. This shape advantageously provides frame member 200 with a greater overall radius and, accordingly, provides more clearance between frame member 200 and a user's head when worn, easily allowing the invention to be worn over the head or under the chin. The central portion of frame member 200 also may be configured as a reverse loop 208, suitably enhancing the tension in the frame and thereby suitably enhancing the constant pressure forces supplied by head contact assemblies 300 and 400 against the user's temple areas 600 when the invention is worn.

Figure 9:
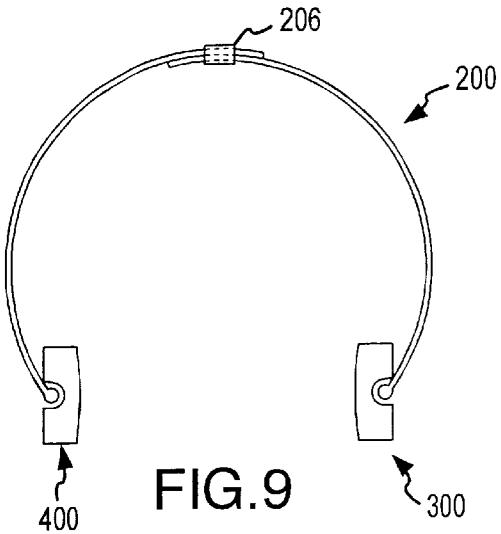
FIG. 9 is a front view of a alternate embodiment of a pressure application apparatus.

FIG. 9 illustrates a further exemplary embodiment which combines the frame member 200 configuration as illustrated in FIG. 8 with a slidable coupling 206 as illustrated in FIG. 7. This configuration illustrates that the many various configurations encompassed by the present invention may also be combined in a number of ways, providing a number suitably combined advantages. In this particular configuration, a greater overall radius may allow the invention to worn over the head or under the chin, while slidable coupling 206 may further allow a user to adjust the amount of pressure applied by head contact assemblies 300 and 400 against the user's temple areas 600 when the invention is worn.

Figure 10:
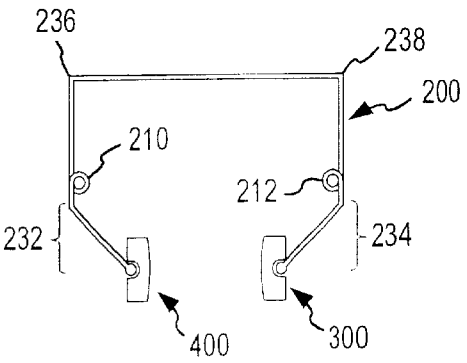
FIG. 10 is a front perspective view of an alternate embodiment of a pressure application apparatus.

FIG. 10 illustrates yet another exemplary embodiment wherein frame member 200 may be substantially square-shaped and, for example, made of 3/32" stainless steel spring wire. In this configuration, frame member 200 includes at least two angular sections 236 and 238, both sections comprising approximately 90 degree angles. The central section of frame member 200, between angular sections 236 and 238, may be worn over the head or under the chin. Frame member 200 then extends from angular sections 236 and 238 along the sides of a user's heads to the end sections 232 and 234 of frame member 200. Each end of frame member 220, illustrated at sections 232 and 234, may be configured to extend approximately at a 45 degree angle towards the user's temple areas 600. Furthermore, frame member 200 may comprise loops 210 and 212, located above and proximate to angled sections 232 and 234, advantageously enhancing the tension used to supply the constant pressure forces applied by head contact assemblies 300 and 400 to a user's temple areas 600 when the invention is worn.

In each of the aforementioned embodiments, frame 200 is provided in a semi-rigid form suitably configured for placement over a users head or under a users chin. It should be appreciated, however, that the various frames which may be utilized in the context of the present invention are not so limited. For example, with reference now to FIG. 11, frame 200 may suitably comprise a stretchable headband. For example, headband frame 200 may be formed from a suitable fabric and elastic, and thus is wearable around a user's head. In this exemplary configuration, the stretchable headband comprises head contact assemblies 300 and 400 which are coupled to the inner circumference of the headband. Headband frame 200 and head contact assemblies 300 and 400 are configured such that, when the invention is worn, assemblies 300 and 400 may be substantially aligned with the user's temple areas. The elasticity in the headband suitably provides the tension used to apply constant pressure forces to the user's respective temple areas 600 by head contact assemblies 300 and 400, when the invention is worn.

Figure 12:
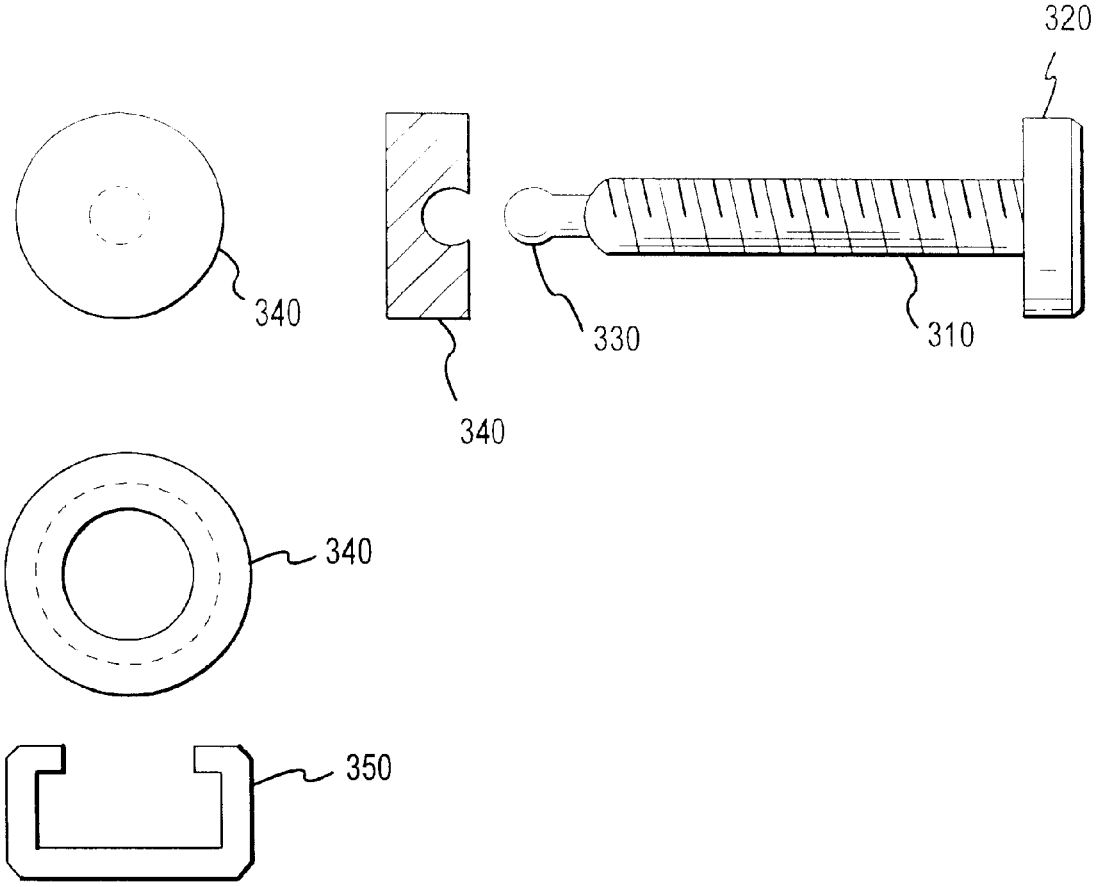
FIG. 12 is a perspective side view of a head contact assembly.

In general, as should now be appreciated, frame 200 can be configured in any manner which enables the application of pressure to a user's temple region. Similarly, and as is illustrated in the various embodiments just described, pressure application devices 300 and 400 also can be variously configured. However, referring now to FIG. 12, preferred embodiments of a pressure application apparatus 300, pressure application apparatus 400 and height adjustment screw 500 will now be discussed. In their preferred embodiments, apparatuses 300, 400 and 500 are structurally similar. Therefore, the three apparatuses will be discussed concurrently and referred to simply as an "adjustable head contact assembly 300/400/500."

Adjustable head contact assembly 300/400/500 suitably comprises a threaded screw portion 310 with an inner end removably coupled to a pressure pad base 340 and an outer end integrally coupled to a pressure control knob 320. Preferably, threaded screw portion 310 is cylindrical in shape with a standard threading. For example, threaded screw portion 310 may have a diameter of approximately ½", a length of approximately 2½" and a ⅜" 16 National Course Class 2 thread, allowing adjustable head contact assembly 300/400/500 to screw into hole 210, 220 or 230, respectively In this preferred embodiment, pressure control knob 320 is preferably substantially disc-shaped. For example, pressure control knob 320 may have a diameter of approximately 1" and a thickness of approximately ¼". Pressure pad base 340 also may be substantially disc-shaped with, for example, a diameter of approximately 1" and a thickness of approximately ⅜". Threaded screw portion 310 then may be suitably coupled to pressure pad base 340 by some flexible joint means, e.g., a ball-joint. If a ball joint is used, the ball may be approximately 9/32" diameter and integrally coupled to the inner end of screw portion 340. The ball may then "snap" into a spherical receptacle of approximately 5/16" diameter suitably formed into the outer end of pressure pad base 340. A "ball-joint" advantageously allows pressure pad base 340 to rotate 90 degrees total and 360 degrees radially about the front end of screw portion 310; however, any other attachment mechanism now known or hereafter devised by those skilled in the art can alternatively be used.

The various elements of adjustable head contact assemblies 300/400/500 are preferably composed of a rigid material such as plastic, metal, ceramic, or any other suitably rigid material.

As generally illustrated, for example in FIG. 1, base 340 is suitably provided with a pressure pad 350. With continued reference to FIGS. 1 and 12, pressure pad may be removably coupled to pressure pad base 340, providing enhanced comfort when adjustment apparatus 300/400/500 is tightened against the user's temple or head. Pressure pad 350 preferably is composed of a soft, stretchable material, such as cloth, rubber, foam rubber, sponge, or any other suitably soft and comfortable material. Pressure pad 350 may be substantially cylindrical, with one closed end and one substantially open end, generally configured to tightly fit around pressure pad base 340. For example, each end of pressure pad 350 may be approximately 1¼" in diameter with the substantially open end including a lip of approximately ⅛", the height of pressure pad 350 may be approximately ⅝", and the all around cross-sectional thickness of pressure pad 350 may be ⅛". In alternate embodiments, pressure pad 350 also may comprise a substantially disc-shaped pad removably coupled to pressure pad base 340 by, for example, Velcro, adhesive, magnet, or any other suitable coupling means. Furthermore, pressure pad 350 may comprise a number of different surface configurations including indents, bumps, raised nipples, or any other suitable surface textures which may provide enhanced comfort and stability when head contact assemblies 300 and 400 are worn against a user's temple area's 600.

It is important to note that although the foregoing description sets forth several preferred exemplary embodiments of the invention, the scope of the invention is not limited to these specific embodiments. Modification may be made to the specific form and design of the described embodiments without departing from the scope of the invention as expressed in the following claims. For example, as noted herein, the various components of the pressure application device herein disclosed may be modified to enable greater comfort to the user or ease in manufacture and/or assembly. Additionally, additional components, if desired, may be added.

What is claimed is:

1. An apparatus attachable to a user's head to aid in providing relief of headaches, the apparatus comprising:

a substantially C-shaped frame configured to fit the user's head, said frame consisting essentially of first, second and third threaded receiving holes within a semi-rigid material;

a first head contact assembly coupled to said frame by a portion of said first head contact assembly being received in said first receiving hole and positioned for substantial alignment with the left temple area of the user, said first head contact assembly configured to impart a substantially constant force to the user's left temple area, said first head contact assembly comprising a threaded screw portion having an inner end removably coupled to a pressure pad base and an outer end integrally coupled to a pressure control knob;

a second head contact assembly coupled to said frame by a portion of said second head contact assembly being received in said third receiving hole and positioned for substantial alignment with the right temple area of said user, said second head contact assembly configured to impart a substantially constant force to the user's right temple area, said second head contact assembly comprising a threaded screw portion having an inner end removably coupled to a pressure pad base and an outer end integrally coupled to a pressure control knob; and, a height adjustment device coupled to said frame at a midpoint of said frame by a portion of said height adjustment device being received in said second receiving hole, said height adjustment device configured to adjust the alignment of said first and second contact head assemblies relative to the user's head, said height adjustment device comprising a threaded screw portion having an inner end removably coupled to a pressure pad base and an outer end integrally coupled to a pressure control pad.

2. The apparatus of claim 1 wherein a cross-section of said C-shaped member is configured such that:

an outer circumferential portion of said cross-section is substantially round; and an inner circumferential portion of said cross-section is substantially rectangular.

3. The apparatus of claim 1 wherein said first and second contact head assembly receiving means comprise threaded holes configured for accepting said threaded screw portions of said first and second head contact assemblies.

4. The apparatus of claim 3 wherein said pressure pad is coupled to said inner end of said threaded screw by a ball joint and said pad is substantially disc-shaped.

* * * * *